United States Patent [19]

Pusch et al.

[11] 4,042,026

[45] Aug. 16, 1977

[54] METHOD FOR INITIATING AN IN-SITU RECOVERY PROCESS BY THE INTRODUCTION OF OXYGEN

[75] Inventors: Günter Pusch, Celle; Heinz Jürgen Klatt, Hohne; Walter Fröhlich, Wietze, all of Germany

[73] Assignee: Deutsche Texaco Aktiengesellschaft, Hamburg, Germany

[21] Appl. No.: 655,594

[22] Filed: Feb. 5, 1976

[30] Foreign Application Priority Data

Feb. 8, 1975 Germany ..... 2505420

[51] Int. Cl.[2] ..... E21B 43/24

[52] U.S. Cl. ..... 166/258; 166/251; 166/261; 166/262

[58] Field of Search ..... 166/261, 256, 302, 258, 166/303, 251, 262

[56] References Cited

U.S. PATENT DOCUMENTS

| | | | |
|---|---|---|---|
| 3,000,441 | 9/1961 | Kunetka | 166/261 |
| 3,080,919 | 3/1963 | Harlan | 166/261 |
| 3,208,519 | 9/1965 | Moore | 166/261 |
| 3,361,201 | 1/1968 | Howard | 166/261 X |
| 3,565,174 | 2/1971 | Parker | 166/261 |

OTHER PUBLICATIONS

Liepmann et al., "Elements of gasdynamics", Galeit Aeronautical Series, John Wiley & Sons, Inc., N.Y., N.Y., 1957, pp. 124–130.

Rudinger, "Wave Diagrams for Nonsteady Flow in Ducts", D. Van Nostrand Co., Inc., New York, 1955, pp. 4–6 and 71–73.

*Primary Examiner*—Stephen J. Novosad

*Attorney, Agent, or Firm*—Thomas H. Whaley; Carl G. Ries; Charles L. Bauer

[57] ABSTRACT

A method for starting a process to recover energy raw materials from a subterranean formation whereby igniters are injected into the upper region of the formation and inert gas is injected into the lower region of the formation, and thereafter an oxygen-containing gas is injected at a predetermined oxygen concentration and rate to initiate combustion, followed by increasing the oxygen concentration and/or rate of the injected gas to a maximum value.

15 Claims, 1 Drawing Figure

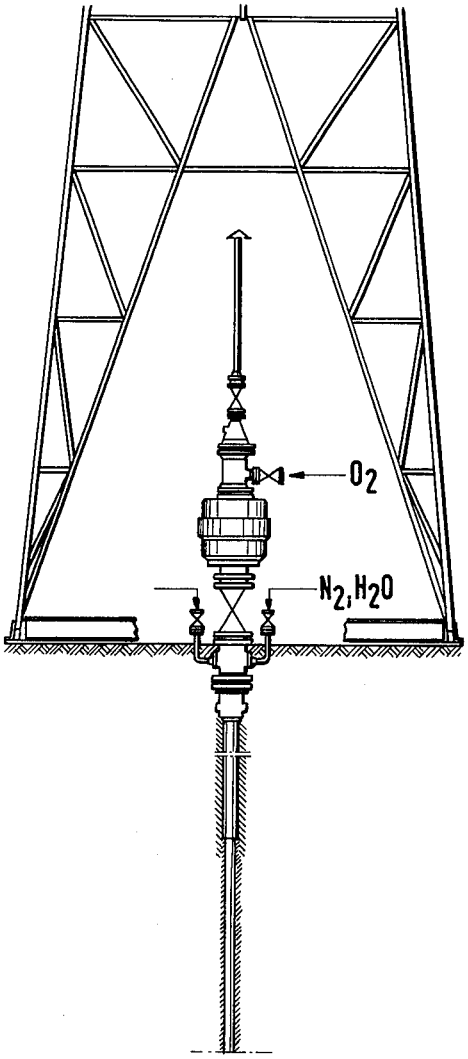
$O_2$
$N_2, H_2O$
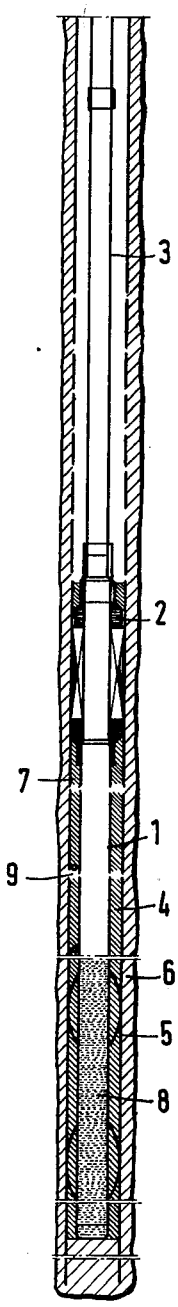
3
2
7
1
9
4
6
5
8

METHOD FOR INITIATING AN IN-SITU RECOVERY PROCESS BY THE INTRODUCTION OF OXYGEN

BACKGROUND OF THE INVENTION

This invention relates to a method for initiating an in-situ recovery process or for starting the operation of the process to recover energy raw materials from a subterranean formation by the introduction of oxygen into the formation.

Since the invention of the underground combustion method for petroleum recovery by F. A. Howard in 1923, a number of methods have been developed, the object of which is the production of heat within the reservoir, especially of sufficient heat, by means of partial combustion of oil residues in a petroleum reservoir to enable recovery of the remaining oil. The most important processes contributing to petroleum displacement are viscosity reduction by means of heat, distillation and cracking of the oil and of the higher boiling components, sweeping out of the oil with hot water and extraction of the oil by means of miscible products. Such a method is specified, for example, in U.S. Pat. No. 3,026,935. Specific modifications of this method require a high oxygen partial pressure in order to bring about miscibility of the carbon dioxide formed during combustion. A high oxygen partial pressure can generally only be obtained by enriching the combustion-supporting gas with oxygen. Oxygen is known to be a gas which reacts readily with almost all substances. The amount of combustion heat released for example in a reaction between oxygen and organic fuels is considerable. On average it amounts to 3000 kcal per kg oxygen.

One of the disadvantages of the use of oxygen is its hazardous nature that could lead to uncontrolled reactions or explosions. Because of the hazardous nature of pure oxygen in reacting with other materials much work has been done to reduce this danger. In addition to the question of reaction of oxygen with various materials the dynamics of compressible fluids is also an important factor in determining what hazard exists when a material is reacted with oxygen.

Great importance is accordingly attached to the structure of the spaces in which the oxygen is flowing. Should said spaces possess a large inner surface in relation to the volume then the danger of an explosion when a fuel and oxygen are reacted is greatly reduced. Consequently the reaction of oxygen with oil contained in the pores of the reservoir rocks poses relatively few problems. However, given certain geometric proportions of the spaces through which the oxygen flows, local temperature peaks can occur, which, although not in accordance with the laws of the dynamics of compressible fluid, cause ignition of the material (steel, plastic, wood etc.).

Finally it is known from experience in autogenous gas cutting that not only the nature of the material but also the composition of the gas used has an influence on the material's cutting quality. With an oxygen content of less than 95%, steel can still be ignited but combustion is not self-sustaining. These ratios apply to atmospheric pressure. However there exists no practical experience with regard to high pressures as found in deep petroleum reservoirs.

If one proceeds from the assumption that the operation of oxygen plants above ground can be considered relatively safe and that the reaction of the oxygen with the oil in the reservoir can be controlled, then it follows that the most dangerous point along the oxygen's flowpath is the borehole. The operating conditions in a petroleum borehole are such that when high percentage oxygen is introduced there is a great danger of an explosion in the borehole. Neither is the borehole equipment made from deflagration-proof material (copper, Inconel) nor is the condition of the equipment, due to contact with corrosive, erosive and organic agents, such that the danger is lessened.

It is therefore the objective of this invention to eliminate these risks or at least reduce them to an acceptable level within the framework of conventional equipment used in boreholes for the recovery of energy raw materials such as petroleum hydrocarbons.

BRIEF DESCRIPTION OF THE DRAWING

The accompanying drawing illustrates the method used in the invention.

DESCRIPTION OF THE PREFERRED EMBODIMENT

In order to achieve this objective, a method for starting the operation of a process for subterranean recovery of energy raw materials by introducing oxygen into the penetrated reservoir was developed, characterized in that, igniters known per se are injected into the upper region of the reservoir, that simultaneously an inert gas is injected into the lower region of the reservoir to prevent the igniters penetrating into this region, that subsequently a gas with a predetermined oxygen concentration and a rate of injection is introduced until a corresponding increase in temperature indicates that ignition has taken place and a combustion front is formed, that injection of the gas is continued at the same rate until the combustion front is at a predetermined distance from the injection borehole, whereafter the rate of injection and/or oxygen concentration is increased to a predetermined maximum rate or end concentration, that the oxygen is injected into the reservoir through at least one radially arranged outlet opening with a pressure ratio of flow-in pressure to discharge pressure at the outlet opening of from 1.2 to 2.5 and that simultaneously water is injected into the upper region of the reservoir.

An advantage of this method is that the injection of the igniters and the gases into the reservoir by means of two vertically unconnected regions avoids oxygen and residual oil from the reservoir coming into contact with igniters in the borehole, thereby eliminating the dangerous phase during the injection of oxygen.

A more complete understanding of the performance and advantages of the invention may be had by referring to the drawing. The drawing illustrates a cross-sectional view of a borehole traversing the subterranean reservoir containing the energy raw material.

Packer 2 with Liner 1, made of high-grade steel, is set in the casing and cemented in the borehole. Prepared cement 4, mixed with suitable setting inhibitors, is previously pumped into the borehole up to a specific level. Once packer 2 has been set at the correct height the superfluous cement 4 is circulated off. An injection pipe 3 is screwed into packer 2. This string has a flexible part to equalize tensions resulting from changes in temperature and pressure. Only dry gases are injected through pipe 3. The injection gas is passed from the borehole into the reservoir via openings 9 which have been subsequently perforated through liner 1, the first cement ısing 4, casing 5 and the second cement casing 6. The ımber of openings and their cross-sectional area is ıch that, at given specific injection rates and injection ressures, "critical flow conditions" exist within the ıtlet openings.

It was found, surprisingly, that given said flow condi-ons and conditions similar to them, neither combustion the metal nor an explosion due to organic residues ccurred. The critical flow conditions are defined such ıat at the appropriate temperature the gas is expelled at ıe velocity of sound. At this point it draws heat from ıe surrounding area to such an amount that rapid cool-g occurs, thus preventing the ignition temperature of eel (~ 1100° C) and of organic residues (> 150° C) ing reached. The velocity of sound of the gas is ached with the pressure ratio prior to, and behind the ıtlet opening reaches 1.89. The pressure gradient of ıe borehole wall is generally determine by means of ıe injection pressure, the injection rate, the number of rforation openings plus their cross-sectional area and rm, and the back pressure in the rock (reservoir pres-ıre and friction loss in the rock). Only two of said ıaracteristic magnitudes are independently variable, e remainder being fixed.

If one of the two pressures is given and the other is ıriable, and in addition the maximum injection rate is ted, then the outlet cross-sectional area required to otain critical flow conditions can be calculated.

$$F = \frac{q}{v\,[1 - (\gamma - 1)/2]^{1/\gamma - 1}}$$

$$v_{max} = a_s = \{[2\,\gamma/(\gamma + 1)]g\,R'T\}^{1/2}$$

$F$ = outflow cross-sectional area ($m^2$)
$q$ = gas flow rate in the pipe ($m^3/s$)
$v$ = flow velocity in outlet opening (m/s)
$T$ = temperature of gas in the pipe (K)
$a_5$ = Laval velocity (velocity of sound in gas which cools during expansion (m/S)
$\gamma$ = adiabatic exponent; for oxygen = 1.4
$g$ = acceleration due to gravity; 9.81 (m/sec.$^2$)
$R'$ = individual gas constants.

In these formulae flow conditions are assumed to be ırestricted. Experience has shown that this simplifica-on can be used to the first approximation.

The following formula is used to calculate cooling at e outlet opening:

$$T/T_s = 1 - \frac{(\gamma - 1)\,(v^2 - a_s^2)}{2a_s^2}$$

$T_2$ = temperature of the expanding gas at Laval velocity (K)

pon obtaining the sonic flow $T_s$ becomes = 0.829 T.

It has been shown that even given rapid compression the gas in the pipe, no ignition of the metal parts or of e organic residue occurs since the perforated pipe rms in addition a "pressure rarefaction zone" and ereby cooling takes place, whereas the compression ıne is clearly only formed on the most extreme peak of e pressure wave.

If residual oil is present in the borehole, or collects ıring the process, or if irremoveable bituminous resi-ıes foul the wall of the pipe, there is an increased ınger of explosion in the presence of oxygen. It has ow been found that this danger can be eliminated if gh grade grit or sand or Raschig rings is introduced and packed into the cavities of the reservoir in which there is a danger of explosion. Grit packing 8 is therefore introduced into the extended liner 1, here having the form of a "sump", in order to render any residual oil present harmless in the presence of oxygen.

Obviously, in place of high-grade steel, cooper, brass, Inconel or Monel or other nickel alloys can be used as material for the liner. It is of particular advantage to maintain the oxygen concentration below 96% as this then rules out the possibility of autothermal (self-sustaining) combustion spreading. According, in the subject method it is not essential that the oxygen be of the highest purity.

Occasionally admixture of inert gases, such as nitrogen, carbon dioxide or steam, is recommended in order to desensitize the oxygen. The oxygen should then be between about 80% and 96% pure.

The method for starting the operation of underground combustion (as described for example in German Auslegeschrift 2,263,960 and in German Patent No. 2,132,679) is performed in the following sequence of steps.

Phase I

The pressure in the petroleum reservoir is reduced as far as is possible and is necessry.

Since it is known that in an explosion the pressure can increase to 5 to 10 times the initial pressure, it is considered expedient for safety reasons to reduce the pressure in the reservoir, in a manner known per se, to slightly above the bubble-point of the reservoir liquid.

The igniters are injected into the upper region of the reservoir via the annulus, in the approximate sequence diesel oil, chemical igniters, water. The dimensions and composition of the chemical igniters can be determined for example in the manner described in German Auslegeschrift 2,263,960. The diesel oil slug should be of the same magnitude (volume) as the chemical igniters slug. By means of nitrogen all the igniters are injected into the formation via the annulus. Simultaneously nitrogen is injected at a low rate (low excess pressure) into the reservoir via injection pipe 3, in order to prevent the igniters circulating back into the high-grade steel linear and injection pipe. When the chemical igniters are injected into the formation the ignition gas (20% - 80% volume oxygen concentration) is injected at the specific rate of approx. 10 - 50) $m^3/m^2$ rock surface per hour (gas volumes under normal conditions) until thermocouples set into the cement casing 4 of liner 1 indicate by an increase in temperature that ignition has taken place. The preferred specific injection rate of the gas is about 30 $m^3/m^2h$. The gas is subsequently injected at the same rate until the combustion front is at a distance of approx. 3 - 30 m from the injection borehole. The preferred distance from the combustion front to the injection borehole is about 5 to 15 m. There are then no more liquid hydrocarbons present in this zone, only solid oxidation residues.

Phase II

The oxygen concentration in the injection gas is increased in stages and the injection rate is increased to the maximum oxygen rate as set down in the process. The cross-sectional area of the perforations is calculated from this rate, in order to achieve critical flow conditions. The maximum oxygen rate depends on the process to be performed. It is pointed out here that even in subcritical flow conditions, an adequate cooling effect can be achieved in the borehole region.

Water is simultaneously injected via the annulus. The water/oxygen ratio should be within the range of from 1 - 15 $m^3$ water per 1000 $m^3$ oxygen (gas volumes under normal conditions). The oxygen concentration should be increased in stages, e.g. in three stages, from 30% - 50%, from 50% - 70% and from 70% - 90%. The reservoir pressure is increased until it lies within the range of from 80 bar to, for example, 150 bar.

Provision must be made that, in the event of the process being interrupted, nitrogen can be injected at any time into the injection pipe and into the annulus (Phase I) via a by-pass from the surface. This is to ensure that adequate control over the borehole is maintained (prevention of reflux, cooling down the borehole).

We claim:

1. A method for starting the operation of a process for the recovery of energy raw materials from a subterranean formation penetrated by a borehole comprising the steps of:

a. introducing into the upper region of said formation igniters known per se, b. simultaneously introducing into the lower region of said formation an inert gas thereby preventing intrusion of said igniters into said lower region, c. subsequently introducing a gas with a predetermined oxygen concentration and injection rate into the lower region until ignition occurs and a combustion front is formed as indicated by a corresponding increases in temperature, d. continuing injection of said gas at said injection rate until the combustion front has been moved a predetermined distance into said formation, e. increasing said injection rate of said gas and/or oxygen concentration in said gas to a maximum rate and/or concentration respectively, f. injecting the said gas with the final oxygen concentration through at least one radially arranged outlet opening into the formation with a pressure ratio of flow-in pressure to discharge pressure at the outlet opening of 1.2 to 2.5, and g. simultaneously injecting water into the upper region of said formation.

2. The method according to claim 1, characterized by injecting the oxygen at a pressure at which it flows into the reservoir at the velocity of sound.

3. The method according to claim 1, characterized in that, at the beginning of the injection processes, the reservoir pressure is lowered to slightly above the bubble-point of the reservoir liquid.

4. The method according to claim 1, characterized in that the injection processes are carried out via an injection borehole which, in the region of the reservoir, is divided into an upper and a lower injection region with no direct connection between these two regions.

5. The method according to claim 1, characterized by the oxygen concentration of the gas to be injected amounting to from 20 to 80 vol. %.

6. The method according to claim 1, characterized by increasing the injection rate and/or oxygen concentration in steps.

7. The method of claim 1, characterized by admixing with the process oxygen an inert gas.

8. The method of claim 7, wherein said inert gas is nitrogen, carbon dioxide, steam and mixtures thereof.

9. The method of claim 1, wherein said inert gas is present in amounts of from 4 to 20 vol. %.

10. The method according to claim 1, characterized by the specific injection rate of the gas amounting to from 10 to 50 $m^3/m^2h$.

11. The method of claim 10 wherein the specific injection rate is about 30 $m^3/m^2h$.

12. The method according to claim 1, characterized in that the distance from the combustion front to the injection borehole amounts to from 3 to 30 m, before the injection rate and/or oxygen concentration are stepwise increased to their final value.

13. The method of claim 12 wherein the distance from the combustion front to the injection borehole is 5 to 15 m.

14. The method according to claim 1, characterized by selecting a $H_2O/O_2$ ratio of 1 to 15 $m^3/1000$ $m^3$ $O_2$ (gas volumes at normal conditions).

15. The method according to claim 1, characterized in that all cavities in the reservoir region of the injection borehole in which a contact between oxygen and combustible materials is possible, are filled with porous filling material (e.g. sand, grit packing, Raschig rings).

* * * * *